US006933843B1

(12) United States Patent
Hom et al.

(10) Patent No.: US 6,933,843 B1
(45) Date of Patent: Aug. 23, 2005

(54) DATA STORAGE MODULE FOR A SECURITY SYSTEM

(75) Inventors: Wayne C. Hom, Rancho Santa Margarita, CA (US); Walter Parsadayan, Lake Forest, CA (US); Daniel Perez, Foothill Ranch, CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/322,199

(22) Filed: Dec. 17, 2002

(51) Int. Cl.[7] ..... G08B 13/08

(52) U.S. Cl. ..... 340/545.1; 340/825.31; 340/825.69; 340/825.72; 340/691.2; 340/693.5; 340/5.25; 340/5.71; 318/139; 318/466; 318/808; 318/809; 318/810

(58) Field of Search ..... 340/545.1, 825.31, 340/825.69, 825.72, 691.6, 692, 693.5, 5.25, 340/5.71; 318/139, 466, 808, 809, 810

(56) References Cited

U.S. PATENT DOCUMENTS 4,576,509 A * 3/1986 Beaty, Sr. ..... 404/6
4,750,118 A * 6/1988 Heitschel et al. ..... 700/90
4,858,383 A * 8/1989 Kendig ..... 49/360
5,729,101 A * 3/1998 Richmond et al. ..... 318/282
6,194,851 B1 * 2/2001 Denault et al. ..... 318/139
6,218,956 B1 * 4/2001 Davis et al. ..... 340/5.2
2003/0174044 A1 * 9/2003 Murray ..... 340/5.25

* cited by examiner

*Primary Examiner*—Tai T. Nguyen
(74) *Attorney, Agent, or Firm*—Fitch, Even, Tabin & Flannery

(57) ABSTRACT

An independent back memory module is disclosed that is permanently installed at a security gate installation. The memory module has a nonvolatile memory and it is positioned within the system so that it automatically has a communication link with any gate controller installed. The memory module records a history of the operation of the system. The memory module retains operational information regarding the system and information identifying the gate controller, gate controller board and the setup of the particular installation. The memory module also retains information regarding changes made in the setup of the system. Whenever a new gate controller board is installed information in the memory module is transmitted to the new controller board.

11 Claims, 5 Drawing Sheets

121
124
125
115
122
123

97
POWER SUPPLY AND/OR BATTERY CHARGER
92
COM INTERFERENCE
CPU
MEM
RAM AND BATTERY
FLASH
EEPROM
FLASH HARDDRIVE
MEMORY CARD
MEMORY STICK
DALLAS BUTTON
DALLAS CHIPS
95
93
91
LINK TO GATE OPERATOR CONTROL BOARD
71

DATA STORAGE MODULE FOR A SECURITY SYSTEM

FIELD OF THE INVENTION

The present invention relates to security barrier systems and more particularly to a system and method for recording and updating the operational parameters and recording of operational history of a security barrier system.

BACKGROUND OF THE INVENTION

Security gate systems have become quite sophisticated apparatuses that often rely on a dedicated computer for their operation. These computer systems are generally referred to as barrier or gate controllers. These systems are used in gated communities, industrial complexes, apartment complexes, single-family housing etc. The actual barrier used can be a swinging, sliding or raising gate. The systems also use a variety of sensors for determining the presence of vehicles and when the barrier can be safely opened or closed.

Given the sophistication of the computers used with these systems and the different types of systems they can function with it is necessary to tailor the computer, i.e. the gate controller, to the specific system it is operating with which usually requires a trained technician to be present when the computer is installed or replaced at a security gate installation to assure that the computer is properly mated with the system.

Also, given the location of most of these systems in exposed locations outdoors they are subject to often-harsh local weather and climate conditions. There is a tendency for the need to frequently repair and/or replace various parts of the system including the dedicated computer functioning at the security system. The computer typically is a computer board with various functional elements necessary for its operation. To repair such a device requires its return to the original manufacturer or a service center. When the board arrives at the manufactures facility or the service center generally only minimal information is available to assist in diagnosing the problem or problems that caused the failure. Although the board can be repaired or replaced there may underling problems at the security gate installation that caused the problem in the first place and the replacement system will eventually fail due to the same cause. Thus, what is lacking is a history of the type of location the computer board came from, previous service calls made at the installation, the reason for these service calls and the frequency of those service calls. Additionally, information on previous computer boards at the subject site and problems they may have experienced is lacking. Thus, if the site continues to have problems it may require the sending of a trained technician to the subject site on one or more occasions to determine the cause of problems at the subject installation.

Thus, what is need is a system and method for facilitating the quick and cost effective installation of a computer system at a security barrier installation. A system and method that will also create a record of prior repair and operation experience at the site that is readily available to the manufacture or service company to help diagnose problems at a security barrier installation.

SUMMARY

Thus, it is an objective of the present invention to provide a device for storing the operational parameters of a security system that can be used to integrate a computer system into the installation. Additionally, it is an objective of the present invention to provide record of operational experience and repairs to a security barrier installation that is readily available to assist in determining the cause of problems with the operation and maintenance of the security barrier installation.

The present invention accomplishes these and other objectives by providing a security system having a operational parameter retention apparatus, the system which includes: a. a dynamic independent memory module capable of saving and retaining various parameters of a security system; b. a barrier movable between an open and closed position; c. a barrier movement mechanism for moving the barrier between the open and closed position; d. a barrier controller for controlling the opening and closing of the barrier by controlling operation of the barrier movement mechanism, the barrier controller being detachably and communicatively connected to the system; and e. wherein the memory module is positioned in a permanent protected location within the security system, is automatically connected to a barrier controller when the controller is connected to the system and the memory module exchanges with the barrier controller various parameters regarding the security system.

In an additional aspect of the present invention it provides a memory module that is located in a communication link harness that detachably connects the controller to the security system.

In another aspect of the present invention parameters retained by the memory module and communicated to a controller connected to the system include at least one or more of the parameters taken from the group consisting of: a types of barrier the system has, types of sensors the system has, operational characteristics of the system, minimum and maximum closing and opening times, number of service calls performed on the system, number of times the barrier has opened and closed in a preset time period, a record of system failures or problems over time.

In a further aspect of the present invention the memory module has its own unique identifying indicia and a barrier controller connected to the system has its own unique identifying indicia and wherein when a barrier controller is connected to the system the memory module and the barrier controller exchange their unique identifying indicia and each retain such information.

In a further aspect of the present invention the memory module retains a record of unique barrier controller identifying indicia of every barrier controller connected to the system and transfers that information to any barrier controller connected to the system along with the parameters.

BRIEF DESCRIPTION OF THE DRAWINGS

The invention will be better understood by an examination of the following description, together with the accompanying drawings, in which:

FIG. 5 a diagram of a sliding gate system that the present invention could function with;

FIG. 6. a diagram of a swinging gate system that the present invention could function with;

DETAILED DESCRIPTION OF THE PREFERRED EMBODIMENT

Figure 1:
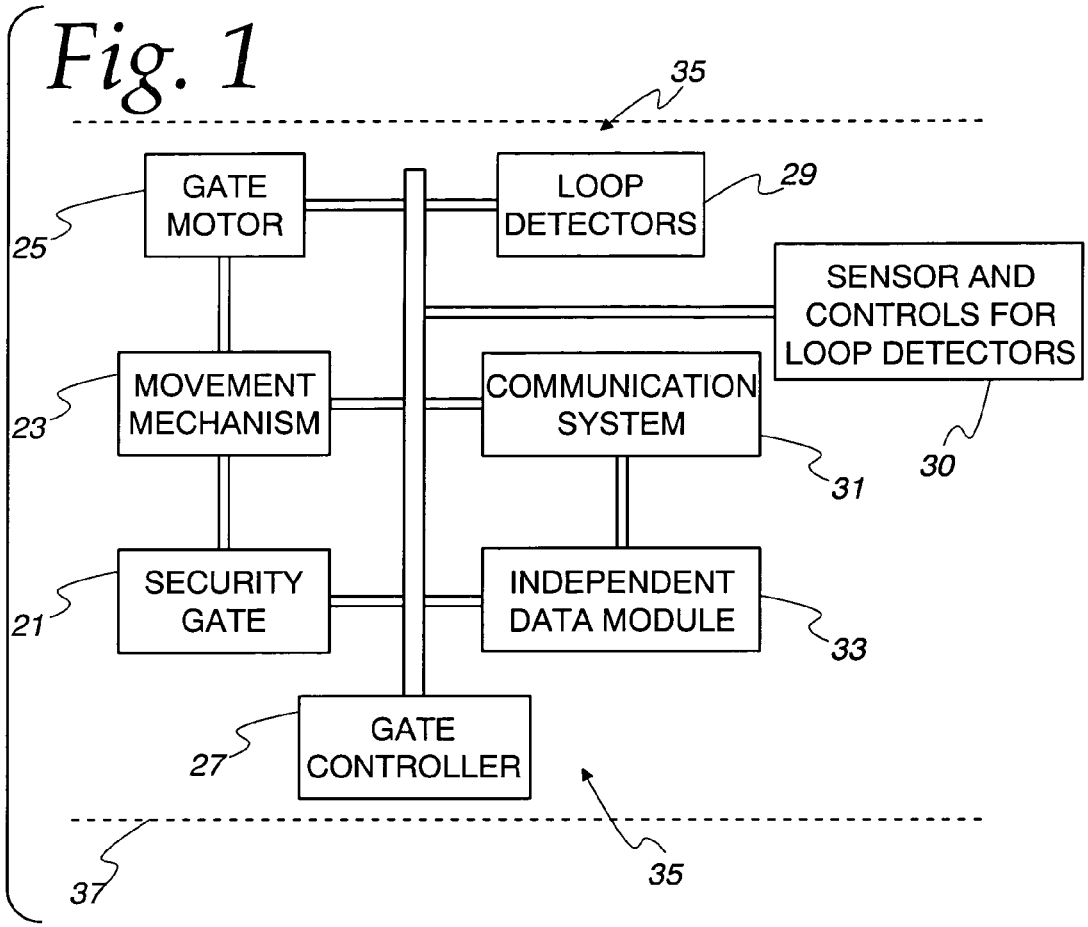
FIG. 1 a block diagram of the major functional components with which the present invention could function.

The present invention provides a memory module that is embedded in the local gate system and has information specific to that system that it retains and communicates with the gate controller connected to the system. Referring to FIG. 1, at a minimum, in the preferred embodiment of the present invention, a security system with which the invention is used would have a security barrier 21, a movement mechanism 23, a gate motor 25, a gate controller 27, loop detectors 29, sensors and controls 30 for the loop detectors, a communication system 31, an independent memory module 33 and an electrical connection and communication harness 35.

Security gate 21 could be a swing, sliding or rising barrier or gate. Movement mechanism 23 would be the standard gear and belt drives needed to translate power from gate motor 25 to the security barrier 21 to move it between and open and a closed position. Loop detectors 29, as will be explained in more detail below, are placed in and around security barrier 21 to detect the presence of vehicles. Communication system 31 can be any standard type of communication device of devices used with a typical security barrier 21. Such communication devices could include a telephone system, not shown, with speaker, mike, keyboard and display with a listing of telephone numbers of occupants of the secure area protected by the security system. A person arriving at the gate can call an occupant within the secure area to obtain authorization for the opening of the barrier and admission to the secure area. Such communication systems can also include a transponder that communicates with transponders or barrier openers located in vehicles, not shown arriving at security gate 21. Upon receipt by the transponder of the security barrier of a security code sent by the transponder or barrier opener in the vehicle and decoding and confirming it is a valid code by gate controller 27 opens barrier 21 by operation of gate motor 25 and movement mechanism 23.

Gate controller 27 is a dedicated computer/control system that monitors and controls the operation of security gate system 37 enclosed within dotted lines in FIG. 1. Communication and electrical connection harness 35 connects the components of the security gate system 37 to controller 27. The present invention includes an independent memory module 33 that connects, in the preferred embodiment, to gate or barrier controller 27 through harness 35. Another variation described below connects by a wireless link and is positioned within the gate controller housing As will be explained in detail below independent data module retains key information regarding the operation of the system that it communicates to gate controller 27. Additionally, gate controller 27 under appropriate circumstances updates the information contained in independent memory module 33.

Figure 2:
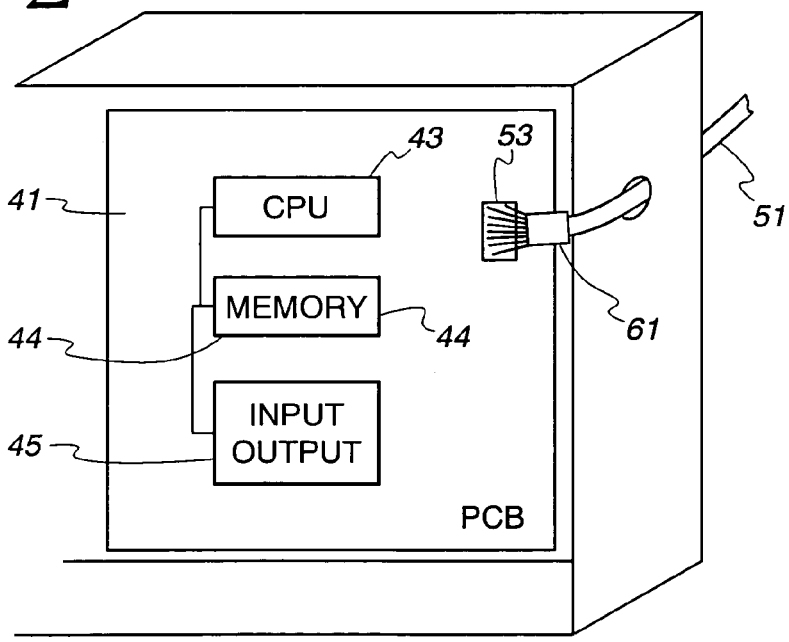
FIG. 2 a simple schematic diagram a controller board installation that includes the present invention.

Gate controller 27 is generally a programmable dedicated computer at the heart of which is typically a main controller or computer board 41 (FIG. 2). Controller board 41 in the preferred embodiment is a printed circuit board with appropriate circuitry (not shown) and various chips and other devices to make it a fully functional computer. At a minimum the board will have a CPU 43, memory 44 and standard input/output devices 45 for communicating. Control board 41 connects to the other peripheral devices of the system, such as loop detectors 29, the communication system 31, motor 25 etc. by electrical harness 51 at connection 53. A single electrical connection harness 51 that attaches at one connection to board 41 facilitates quick and economical replacement and repair of controller board 41. Alternatively, memory module 61 could connect to board 41 through its own separate connection. Additionally the memory module could be separate from the connection harness and not be part of the harness. In such a situation it could be a separate module attached to an inside surface of the gate operator housing with its own connection.

Figure 3:
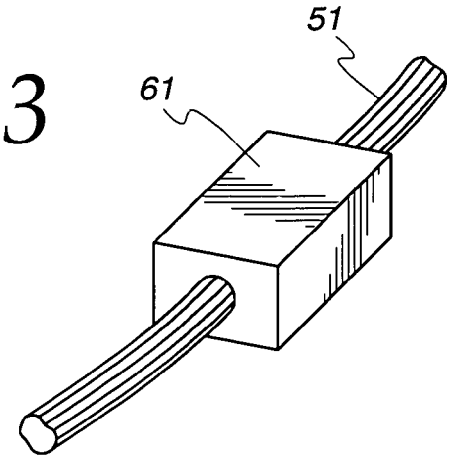
FIG. 3 a diagram of one embodiment of the present invention.

In a preferred embodiment of the present invention memory module 61 is embedded in harness 51, or at least attached in a secure fashion to harness 51. FIG. 3 provides a close up view of modular memory 61 and how it is encapsulated around harness 51.

Figure 4:
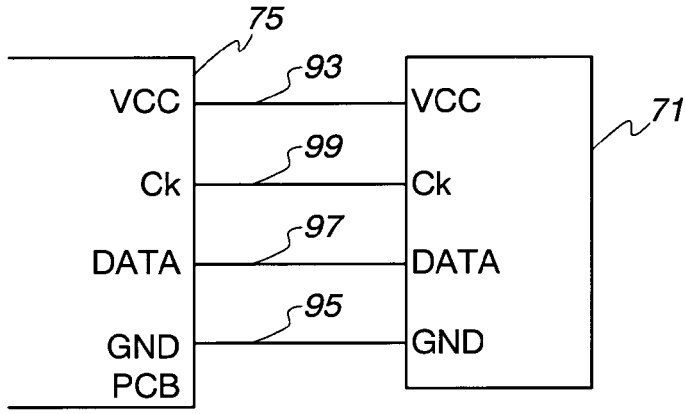
FIG. 4 a simple schematic diagram of one communication set up of the present invention.

FIG. 4 is a schematic block type of diagram one version of a communicative link that could connect memory module 71 and the controller board through input/output device 75 on board 41. Such a basic connection would include power 93 and ground 95 as well as a data line 97 and a clock line 99. Any number of different types of communication protocols can be used in the operation of the gate controller and the communications between the gate controller and the rest of the system. Among several standard communications protocols, but not limited to, that can be used are RS-232, RS-485, I Bus, SPI and $I^2$ C. Such communication systems are well known to those of ordinary skill in the art. In fact anybody of ordinary skill in the art can use any standard communication protocol. Communication and exchange of information could be conducted between controller 27 (FIG. 1) and independent data module 33 using anyone of these communication systems. The operating systems used in standard security gate systems are well known in the art. Additionally, the specific parts of controller 27 and the other peripheral devices as well as their interconnection are not included herein since these are well known in the art.

Figure 7A:
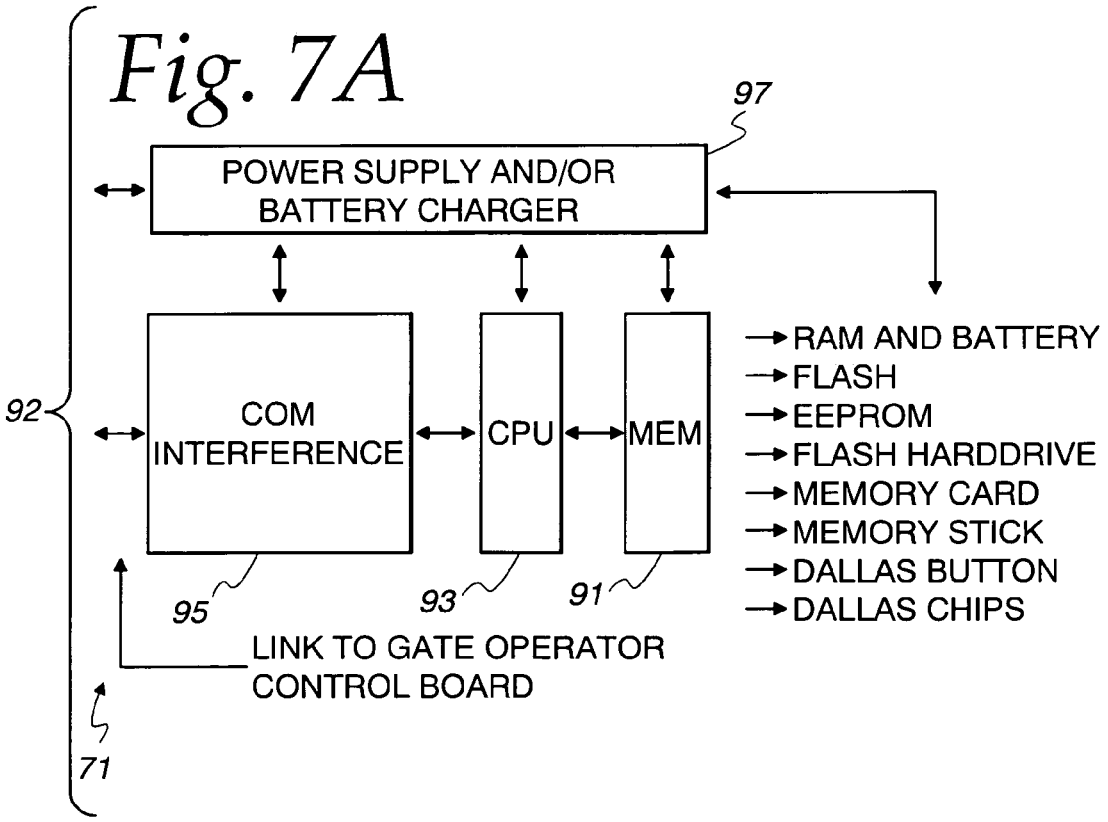
FIGS. 7A–7D are schematic diagrams of variations of the memory module of the present invention.
Figure 7B:
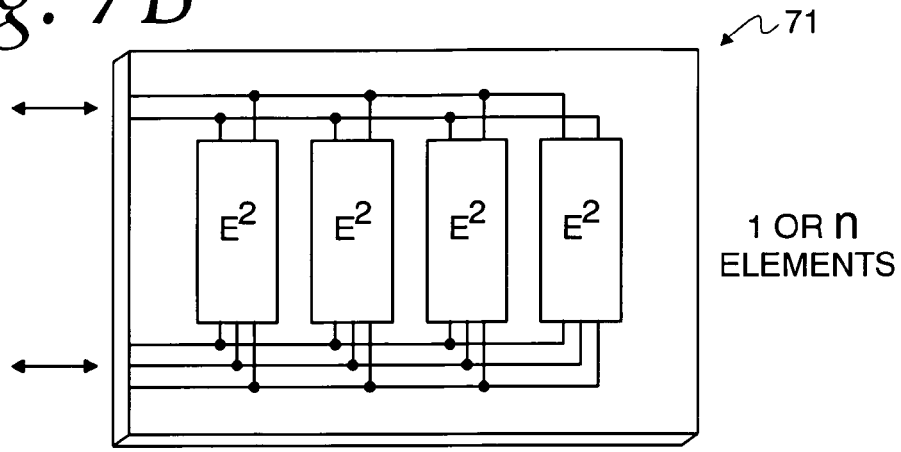
Figure 7C:
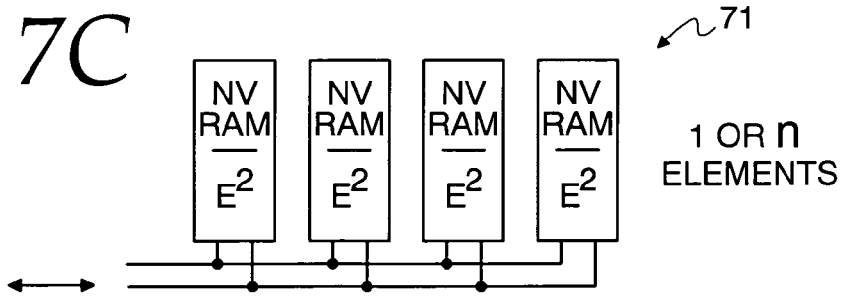
Figure 7D:
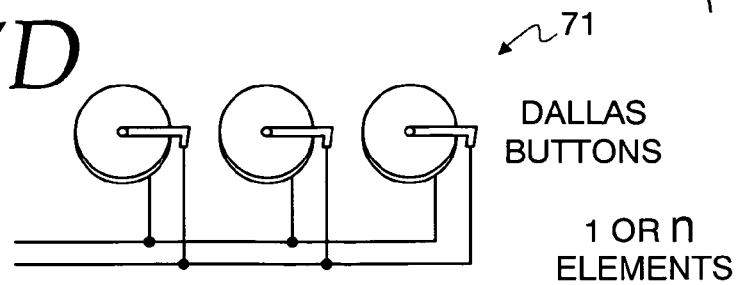

Memory Module 61 (FIG. 2), in the preferred embodiment, would have a non-volatile memory capable of retaining information on whether or not it has power. FIGS. 7A–7D provide a schematic diagram of different variations of memory module 71. FIG. 7A provides a schematic block type diagram of a fairly sophisticated memory module. Memory module 92 includes not only basic memory 91, but a CPU 93, and an interface 95 to the gate operator control board. Additionally when the memory module 92 is operating, it would be supplied with power from the gate system by either a power supply or battery charger 97. Memory 91 can be in a variety of different forms, which include: 1.) Random Access Memory with a battery backup, 2.) A Flash Memory, 3.) An Electrically Programmable Read Only Memory, EE PROM; 3 Flash Hard drive; 4.) Memory card; 5) Memory Stick; 6) Dallas Buttons; or 7) Dallas Chips. Naturally there are other forms of memory that may prove suitable. FIG. 7B provides a simple setup of EE PROM. FIG. 7C provides a schematic diagram of Non-Volatile Read Only Memory, and FIG. 7D provides a view of a memory setup that would employ Dallas Semiconductor type buttons.

FIG. 7A provides a view of a fairly sophisticated memory module that would contain it's own logic and software to provide for retention of the information. Alternatively, the gate controller board could provide the necessary logic and software for the storing of the information, and the module itself could be simply the memory devices themselves such as those depicted in FIGS. 7B, 7C, and FIG. 7D.

Figure 8:
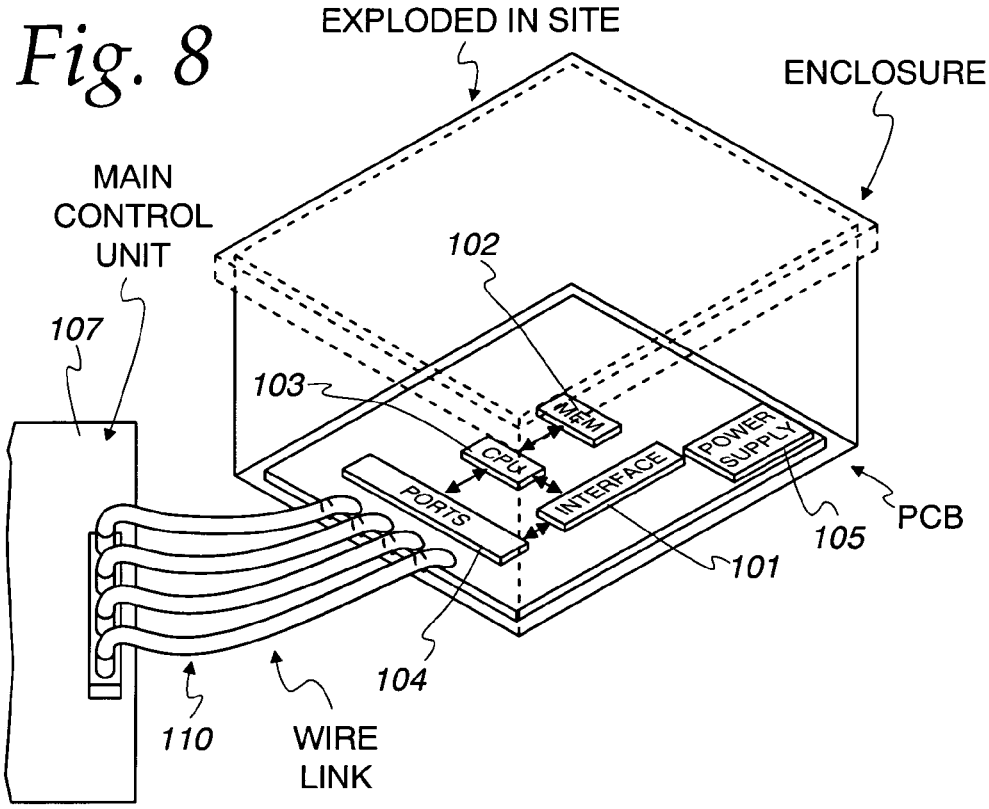
FIG. 8 is a diagram of an alternative means of installing the memory module of the present invention separate from the harness.
Figure 9:
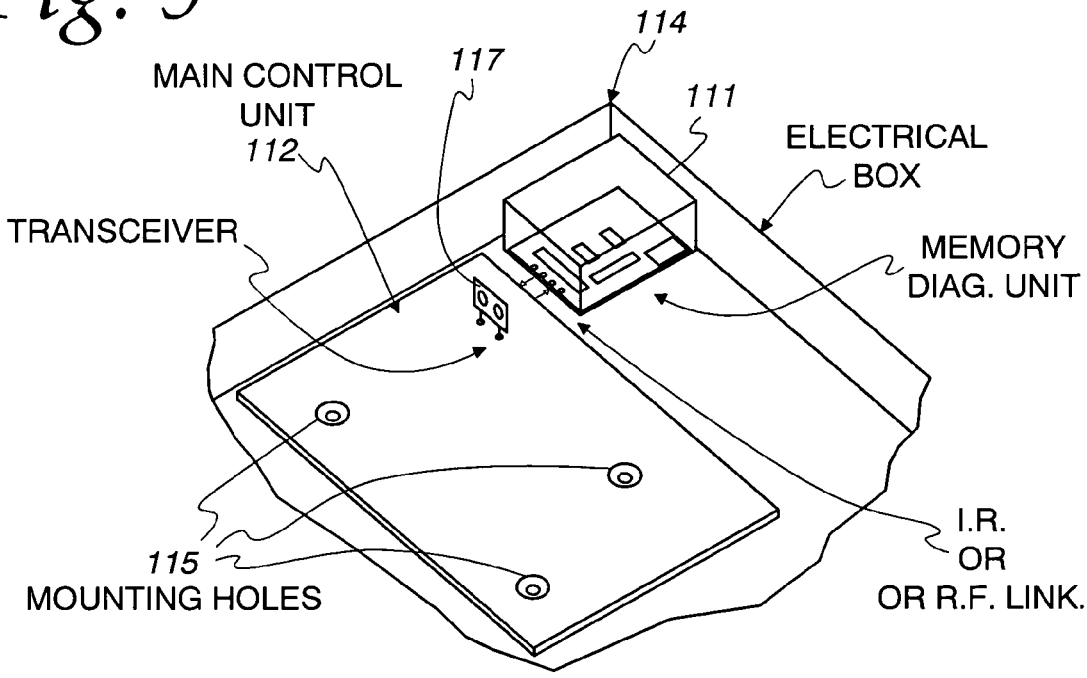
FIG. 9 is a diagram of a third method of installing the memory module.

FIG. 8 provides a schematic type of view of an enlarged version of another preferrd embodiment the memory module which is separate from the harness. In the version depicted in FIG. 8 it would be the similar to that depicted in FIG. 7A, in that it would have it's own Interface 101, Memory 102, CPU 103, Ports or Interface 104, and Power Supply 105. The Unit would be connected to the Main Controller Board by Wire Link 110. FIG. 9, provides for another variation of the Memory Module which connects to the Main Control Unit 112, and Gate Operator Housing 114, by infrared or RF interlink. The mounting holes 115 of Main Control Unit 112 would be strategically placed so that the orientation of the Main Controller Board would place the Communication Unit 117 in a position in which it could establish a communicative link with Memory Unit 111 upon installation. In a standard RF link it would not be necessary to place the memory module, which would have its own transceiver, in any specific position as long as it is in broadcast range of the transceiver that would be on the controller board.

The information retained by memory module would include: 1) number of times the system had been repaired; 2) type of barrier system, i.e. a swinging gate system, sliding gate system or an overhead gate system; 3) the standard maximum and minimum time necessary for opening and closing the barrier, 4) the number and different types of previous controller boards used with the system; 5) number and types of service calls made at the site. The information that could be retained is substantial the above only being some of the possible types of information that could be saved.

Additionally the system of the present invention could include the following information: 1.) The type of Gate Operator, including speed behavior, and sensors. 2.) The memory could retain information regarding the accessories in the unit such as the type of safety loops or exit loops as well as any type of radio communication devices the system may have. 3.) The memory could date and time stamp each event as it occurs, events that it may record could include overstress in the motor unit, motor overload, continuous activation of safety devices such as the bumper edge, inherent current sensor device and photo beams. It could also record continuous activation or abnormal activity of the various controls. 5.) The unit could also include the control board serial number, as well as the serial number for the unit. Additionally, when there have been changes in the main controller board, it can record the serial numbers of each control board that has been installed in the system, and the date and time stamp of it's period of operation, and it's replacements (more on this aspect will be discussed below.). 6.) The system can also record instances of power failures, and voltage overloads.

In another variation of the invention each controller board would be given its own unique identifying indicia that it would communicate to the independent data module of any security system to which the controller board is connected. The independent data module would then retain a record identifying each controller board that has ever been connected to the system. Upon connecting a new controller board to the system the independent memory module would then copy this information, together with other information it has to the new controller board. Thus, this information will be contained on both controller boards attached to the system and the independent data module. In a further refinement of the system of the present invention each independent data module would have its own unique identifying indicia by which it can be identified. This identifying indicia would also be copied to the memory of any controller board attached the security system and be available when needed. In a preferred embodiment the identifying indicia would be a unique serial number. The serial number can be numeric, alpha numeric, alphabetical, symbolic or any other possible way of creating unique identifying indicia.

Security systems designed around gate controllers that have a dedicated computer system are very flexible and efficient given the performance available for even the most simple computer system. However, the typical security system usually operates in an exposed location subject to local ambient weather conditions. Thus, repairs and maintenance of such systems is an ongoing problem with which any manufacturer or ultimate users of such systems must deal. Additionally, most users of such systems, in particular gate communities, will have several security barriers. Equipment as it is used and repaired may be moved from installation to installation. Thus, when the service representative or manufacturer receives a unit, in particular a control board for repair they may not have too much information about its prior history, use or installation it was used in. This lack of prior history may make it very difficult to diagnose the cause of problems encountered with use of the board. Thus, by having an independent data module that retains information on the operational characteristics plus history of changes, repairs etc. a copy of which is down loaded to every board attached to the system such information will be available on the board when it is received by the manufacturer or the service representative for repair. This information will greatly facilitate the diagnosing of the problems of the board and system and the causes of those failures in its operation.

Another advantage of retaining a history and record of system information for the security system in the independent memory module is that when a board is replaced the independent data module can provide the necessary information to the board to adjust to and operate the system in a safe an efficient manner. Barrier security systems come in a variety of different forms. These range from swinging and sliding gates to rising barrier systems. Each of these systems has their own unique characteristics. Additionally, each of the different systems such as swinging and sliding gates can vary in operational characteristics. For instance a swinging security gate can vary in size from installation to installation depending on the need at each installation. Some may call for short lighter gates will others call for heavy longer gates. For each installation the controller board must be programmed and adjusted so that among other things it opens and closes the gate in a safe but not excessively slow manner.

In the past it was necessary to have a special controller board for each installation that the technician would have to make adjustments to the board in order to assure the board functions properly with the installation. Given the computing power now available it is possible to make one board usable in all installations and provide a software program to run the system that can be adjusted for each installation. However, this still requires that a trained technician make adjustments to the board and its software program for each installation. However, by providing an independent data module that saves information regarding the specific security gate system that the board is being installed at it is possible to program each controller board to take the information on the security gate installation from the independent memory module and have the board automatically adjust to operated the system in a safe and efficient manner with a minimal of human intervention after initial programming of the controller board.

Figure 5:
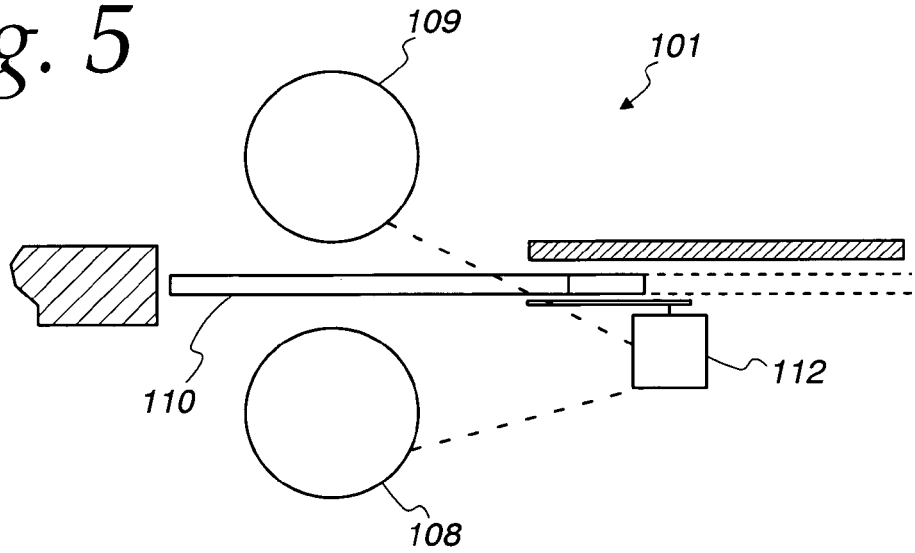
Figure 6:
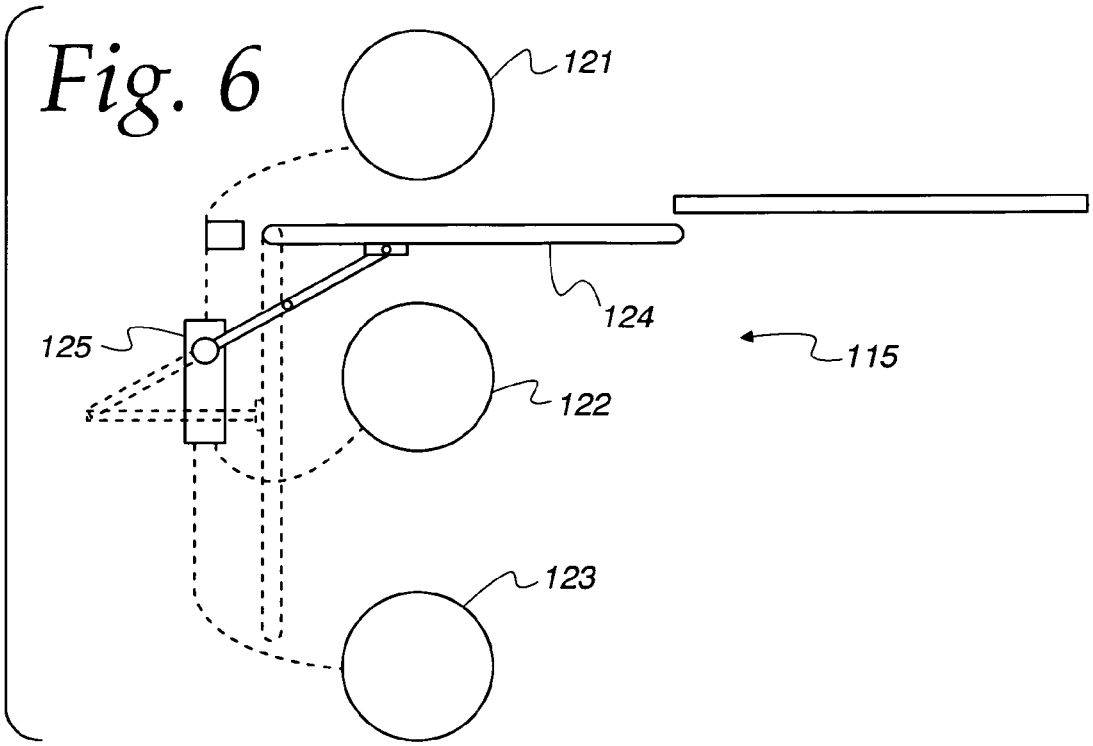

The following is an example of the type of information that independent data module can contain. Typically a sliding gate system 101 (FIG. 5) only requires two loop detectors 108 and 109 on either side of gate 110. Loop detectors 108 and 109 are used by the system to among other things tell the system whether or not a vehicle is still present within the gate area and thus whether or not it can safely open or close the gates. However, a swinging gate system 115 (FIG. 6) requires at least three loop detectors 121, 122 and 123 in order for the system to determine if gate 124 can be safely opened or closed. Thus by using an independent data module that retains information on the characteristics of the particular system the same controller board can be used in the gate controller for both systems. When the controller board is installed it would adjust it operation to the type of system it is operating with. The gate controller and independent data module would be housed in unit 112 for sliding gate 110 (FIG. 5) and in unit 125 for swing gate 124. This is only one example of the type of adjustments a controller board could be programmed for depending on the information contained in the independent data module.

While the invention has been particularly shown and described with reference to a preferred embodiment thereof, it will be understood by those skilled in the art that various changes in form and detail may be made to it without departing from the spirit and scope of the invention.

We claim:

1. A barrier movement system for moving a barrier between open and closed positions comprising:

a barrier movement mechanism for moving said barrier between the open and closed position under control of a barrier controller;

a memory module disposed on said barrier movement mechanism and separate from the barrier controller and capable of storing parameters for control of the barrier movement mechanism;

the barrier controller being removably connectable to the barrier movement mechanism for controlling the opening and closing of the barrier by controlling operation of the barrier movement mechanism, wherein the barrier controller exchanges parameters with the memory module prior to controlling the opening and closing of the barrier; and a removable connection between the memory module and the barrier controller operative to leave the memory module connected to the barrier movement mechanism when the barrier controller is removed.

2. The system of claim 1 wherein said memory module is positioned in a permanent protected location within said barrier movement system, is automatically connected to the barrier controller when said controller is connected to said barrier movement system and said memory module exchanges with said barrier controller various parameters regarding said barrier movement system.

3. The system of claim 2 wherein said permanent protected location of said memory module is in a communication link harness that detachably connects said barrier controller to said barrier movement system.

4. The system of claim 3 wherein communication between various operational components of said system is selected from the group consisting of I bus, I2C, RS-232, RS-485, Infrared and Radio Frequency.

5. The system of claim 1 further including various sensors for determining conditions adjacent to said barrier, said sensors detachably connecting to said controller and wherein parameters retained by said memory module and communicated to a controller attached to said system includes information on said sensors.

6. The system of claim 1 wherein said parameters retained by said memory module and communicated to a controller connected to said system include at least one or more of the parameters taken from the group consisting of: a types of barrier said system has, types of sensors said system has, operational characteristics of said system, minimum and maximum closing and opening times, number of service calls performed on said system, number of times said barrier has opened and closed in a preset time period, a record of system failures or problems over time.

7. The system of claim 1 further including sensors and said memory module includes among said parameters of said system operational information on said sensors.

8. The system of claim 1 further including a communication subsystem and said memory module includes among said parameters of said system operational information on said communication subsystem.

9. The system of claim 1 wherein said memory module is a non-volatile memory capable of retaining information in an un-powered state for an indefinite period of time.

10. A barrier movement system for moving a barrier between open and closed positions comprising:

a barrier movement mechanism for moving said barrier between the open and closed position under control of a barrier controller;

a memory module separate from the barrier controller and capable of storing parameters for control of the barrier movement mechanism;

the barrier controller coupled to the memory module and removably connectable to the barrier movement mechanism for controlling the opening and closing of the barrier by controlling operation of the barrier movement mechanism wherein the barrier controller exchanges parameters with the memory module prior to controlling the opening and closing of the barrier; and wherein said memory module has its own unique identifying indicia and the barrier controller connected to said system has its own unique identifying indicia and wherein when a barrier controller is connected to said system and memory module and said barrier controller exchange their unique identifying indicia and each retain such information.

11. The system of claim 10 wherein said memory module retains a record of unique barrier controller identifying indicia of every barrier controller connected to said system and transfers that information to any barrier controller connected to the system along with said parameters.

* * * * *